United States Patent [19]

Hara

[11] 4,231,355

[45] Nov. 4, 1980

[54] DEVICE FOR AIR-MASSAGE

[76] Inventor: Katsumasa Hara, No. 121-1, 1-chome, Kamishakujii, Nerima-ku, Tokyo, Japan

[21] Appl. No.: 942,709

[22] Filed: Sep. 15, 1978

[30] Foreign Application Priority Data

Sep. 29, 1977 [JP] Japan ..... 52-117102

[51] Int. Cl.[3] ..... A61H 7/00

[52] U.S. Cl. ..... 128/24.2; 128/64

[58] Field of Search ..... 128/24 R, 64, 60, 25 R, 128/26, 62 A, 33, DIG. 20, 24.2

[56] References Cited

U.S. PATENT DOCUMENTS

| | | | |
|---|---|---|---|
| 1,795,893 | 3/1931 | Rosett | 128/64 |
| 2,781,041 | 2/1957 | Weinberg | 128/60 |
| 2,896,612 | 7/1959 | Bates | 128/60 |
| 3,446,203 | 5/1969 | Murray | 128/24.2 |
| 3,548,819 | 12/1970 | Davis et al. | 128/DIG. 20 |
| 3,678,520 | 7/1972 | Evans | 128/24 R |
| 3,717,145 | 2/1973 | Berndt et al. | 128/DIG. 20 |

FOREIGN PATENT DOCUMENTS

| | | | |
|---|---|---|---|
| 276620 | 11/1969 | Austria | 128/64 |
| 1126012 | 7/1956 | France | 128/62 X |
| 2246260 | 2/1975 | France | 128/24 R |
| 262520 | 12/1926 | United Kingdom | 128/64 |
| 526359 | 9/1976 | U.S.S.R. | 128/64 |

*Primary Examiner*—Lawrence W. Trapp

[57] ABSTRACT

A device for air-massage comprises an air inflatable bag and an elastic element connectively surmounted thereon. The elastic element may be moved by feeding or exhausting an air into or from the air inflatable bag, thereby to obtain a massage effect on a body portion.

8 Claims, 12 Drawing Figures

DEVICE FOR AIR-MASSAGE

BACKGROUND OF THE INVENTION

This invention relates to a device for air-massage in which an air inflatable bag is combined with an elastic element which to come into a direct contact with a body portion. The elastic element is connectively surmounted on one surface of the bag and is moved for massage by inflating and deflating the bag with a compressed air.

Heretofore, various types of massaging devices have been proposed in one of which an air inflatable bag made of a flexible material such as rubber is wound around a body portion such as an arm or a leg and the bag is inflated and deflated with a compressed air to apply and release pressure on a blood vessel, thereby to facilitate the circulation of blood (mainly venous blood and lymph) for massage.

This conventional device, however, has the disadvantages that the air bag is inflated into a cylindrical form when filled with the air, so that an arched surface of the bag comes into uneven contact with the body portion. As a result, pressure is localized with a minimum stimulus to give uncomfortable feeling to the body portion. In other words, an over all even contact of the inflated bag with the body portion is difficult to obtain, so that a satisfactory massage effect is not be achieved.

Another type of device for medical treatment employing a variety of the elastic elements has also been proposed in order to obtain the desired physical effects similar to those of finger-pressure therapy and the acupuncture. The device of this type, however, has been designed to treat a local site of a human body and may not be employed for general use. Even if such a device is employed for massage, it is too difficult to obtain a good massage effect making the stream of blood and lymph better.

Moreover, according to this conventional device for a large volume of air is required to kill the air inflatable bag when a strong pressure is to be applied on a body portion, so that an air-compressor of a large capacity is needed, bringing about a disadvantageous increase in the equipment cost.

According to the present invention a new type of device for air-massage is provided which eliminates all the above-mentioned defects and shows a higher massage effect with use of a small volume of air.

Namely, it has now been found that a comfortable massage effect may be achieved by providing a device with an elastic contacting element for a direct massage action to a body portion and an air inflatable bag for inflation and deflation with a compressed air, by connectively surmounting the elastic contacting element on one surface of the air inflatable bag, by winding the device around a body portion such as a diseased site and by feeding and exhausting air in relation to the bag.

Thus, the elastic element comes into an even contact with the body portion and makes the massage effect uniform and comfortable.

Further, it has been found that the attached equipment of the device may be smaller because the higher massage effect may be obtained with a small capacity of the bag using a small volume of the air.

SUMMARY OF THE INVENTION

A general object of the invention is to provide a device for air-massage which comprises an elastic element for direct contact with a body portion and an air inflatable bag connected thereto for receiving compressed air, and by which a uniform massage may be effected in the wide range of a body portion with use of a small volume of the air.

A principal object of the invention is to provide a device for air-massage which comprises an air inflatable bag provided with a port for feeding and exhausting air and an elastic element connectively surmounted on one surface of the bag, the bag being inflated and deflated with the air by communicating the port of the bag with an air source, thereby to operate the elastic element for the massage.

In the device according to the invention, the elastic element may be releasably connected to the air inflatable bag for the convenient manufacture and handling.

The elastic element of the device may be constructed as another air bag which is optionally filled with an adjustable volume of air. Preferably, the elastic element is provided with a tongued and grooved face on a surface in contact with a body portion for enhancement of a massage effect. In this case, the element may be made of an elastic material such as rubber or the like. Alternatively, the elastic element my be made of an elastic plate provided with a plurality of projections on the surface in contact with the body portion.

A further alternative is to provide the elastic element with a plurality of independent air-filled projections on the surface.

According to the invention, a plurality of the air inflatable bags may be connected to the single elastic element, each of which bags may be provided with its own port for feeding and exhausting air. Thus, an undulating massage action may be obtained by changing the duration of feed and exhaustion. In this case, for the purpose of facilitating the connecting and disconnecting operation, the elastic element is preferably provided with a receiving bag for the plurality of the air inflatable bags.

Further, the massage effect may be enhanced by inserting a heating or cooling element of the gel state into the elastic element.

Moreover, in the device of the invention the air inflatable bag may be formed in the shape of a mat which holds the whole body thereon or may be formed into a shaped article which surrounds a certain body portion such as an arm or a leg for easy operation and more effective massage.

For a fuller understanding of the present invention reference should now be had to the following detailed description thereof taken in conjunction with the accompanying drawings.

DESCRIPTION OF SPECIFIC EMBODIMENTS

Figure 1:
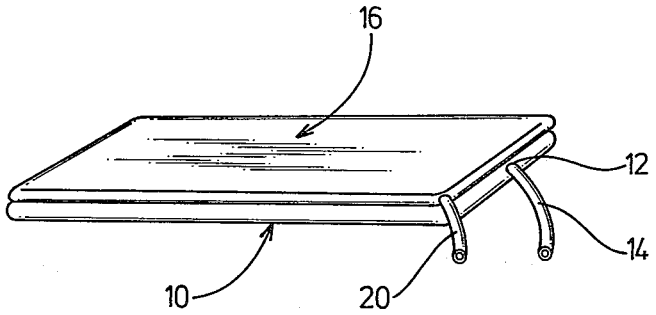
FIG. 1 is a perspective view of the device according to the invention.
Figure 2:
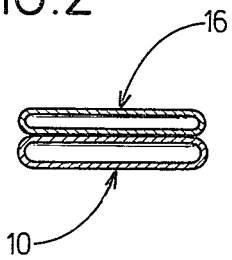
FIG. 2 is a cross sectional view of the device of FIG. 1.

FIGS. 1 and 2 show the fundamental construction of the device according to the invention, in which the reference numeral 10 represents a flat air inflatable bag made of air impermeable material. The bag 10 is provided with an opening 12 for connection with an air tube 14 which is connected to an air source through a valve (not shown) if necessary. Thus, the compressed air may be introduced from the air source through the valve into the bag 10, or the air within the bag 10 may be exhausted through the tube 14.

Figure 3:
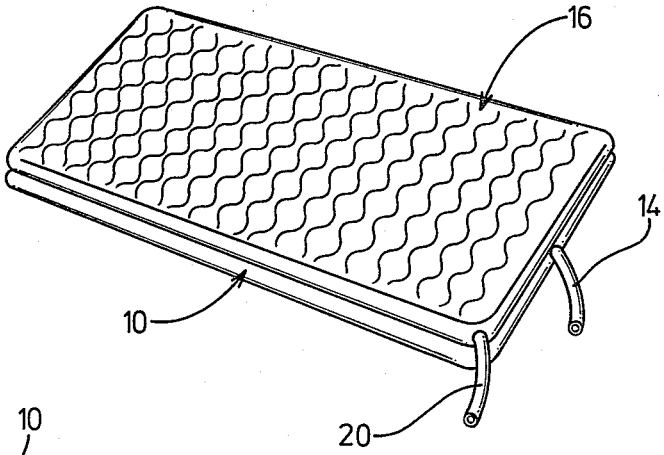
FIG. 3 is a perspective view of another embodiment of the device.
Figure 4:
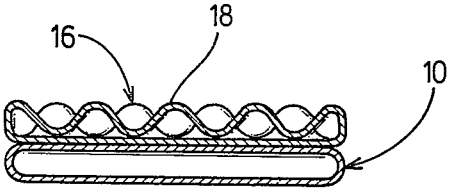
FIG. 4 is a cross sectional view of the device of FIG. 3.

On one surface of the bag 10 is connectively surmounted an elastic element 16 which may be constructed as another air bag. When the elastic element 16 is constructed as the air bag, the surface in contact with the body portion may be flat (FIGS. 1 and 2) or may be provided with the tongued and grooved portions 18 for better massage effect (FIGS. 3 and 4). Further, the air bag 16 used as the elastic element is provided with an air port 20 for adjustment of the air volume so as to control elasticity of the elastic bag element 16.

Figure 5:
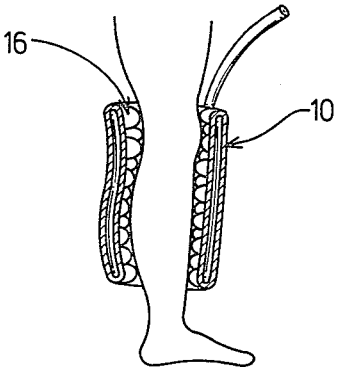
FIG. 5 is a pictorial view of the device on actual use.

The device for air-massage thus constructed brings about the uniform massage action over the whole diseased site covered with the device, as best shown in FIG. 5, by winding the device 10 around the site with the elastic element 16 which is made into a direct contact with the site and by feeding and exhausting air for the bag 10.

In accordance with the invention, the elastic element 16 in contact with the body portion is independently arranged in relation to the bag 10 so as to be movable with the air pressure, so that uniform movement throughout the elastic element 16 is obtained, effecting the even massage action on the body portion contacted with the device. Moreover, in accordance with the device of the invention the role of the bag 10 is only to put air-pressure indirectly onto the elastic element 16 for movement of the latter, so that the total volume inside the bag 10 may be extremely reduced and that the volume of the air used becomes very small. As a result, a compact type of air-compressor may be employed for air feeding.

Figure 6:
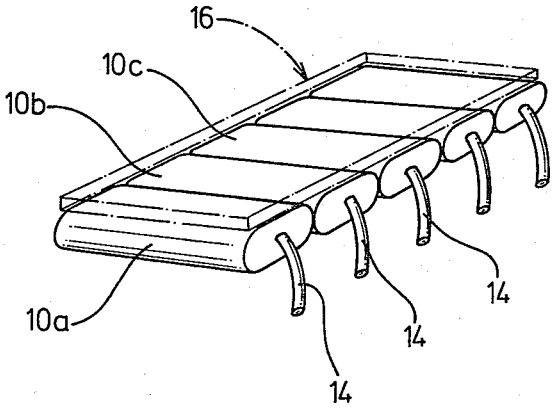
FIG. 6 is a perspective view of another embodiment of the device.
Figure 7:
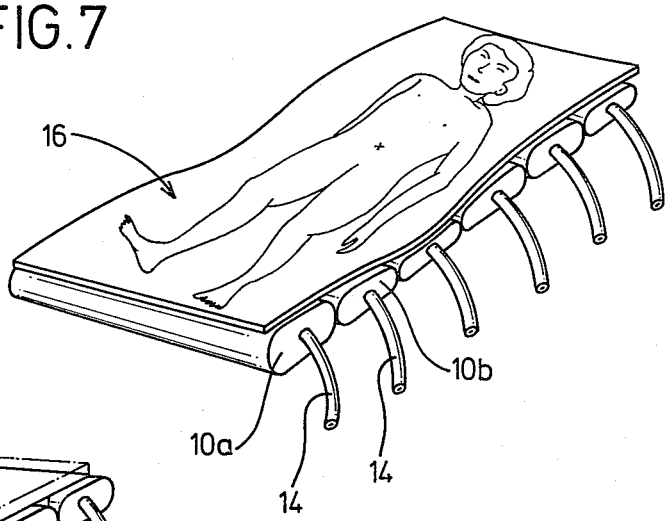
FIG. 7 is a pictorial view of the device of FIG. 6 on actual use.
Figure 8:
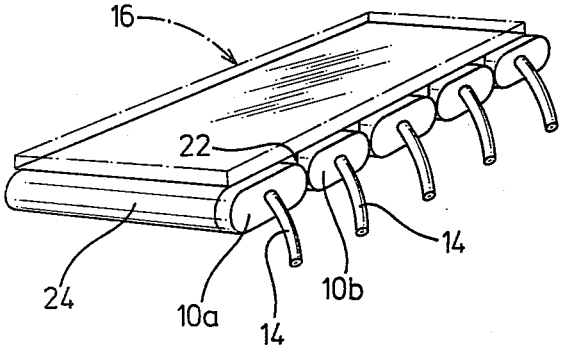
FIG. 8 is a perspective view of the modified device of FIG. 6.

FIG. 6 shows another embodiment of the device according to the invention, in which a plurality of the air inflatable bags 10 are provided for the single elastic element 16. Thus, in this embodiment the bags 10 are provided with their own ports 12 for the air-tubes 14 which are connected to the air source through a change-over valve, so that the time difference may be given between the adjacent bags and the undulating movement of the elastic element 16 may be obtained, resulting in the higher massage effect. In one utilization of this embodiment, as shown in FIG. 7, a plurality of the bags 10*a*, 10*b*, 10*c* . . . are arranged in parallel in the shape of a mat, on the whole upper surface of which is spread the elastic element 16 and the body may be laid on the latter in order to enjoy a comfortable massage effect throughout the whole body. Moreover, in the case of the embodiment using a plurality of the air inflatable bags 10, the elastic element 16 may be connected to a receiving bag 24 having a plurality of receptive areas 22 for holding these bags 10 so that the connecting and disconnecting operations of the bags 10 may be performed conveniently and the device may be conveniently handled.

Figure 9:
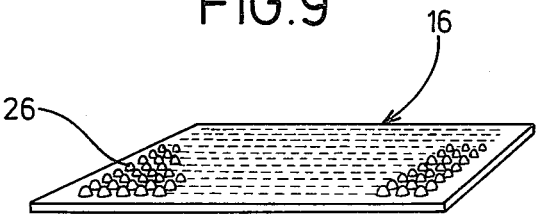
FIGS. 9 to 11 show different embodiments of the elastic element used in the device of the invention.
Figure 10:
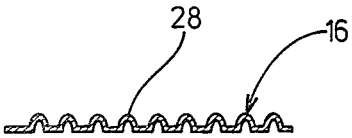
Figure 11:
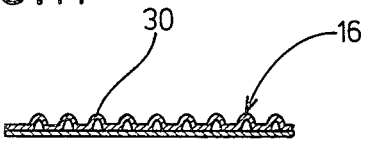

FIGS. 9 to 11 show various embodiments of the elastic element 16 used in the device of the invention. In the elastic element 16 of FIG. 9 there are arranged a plurality of projections 26 made of flexible rubber or plastic material. In FIG. 10, the elastic element 16 with a plurality of the projections 28 is fabricated from relatively hard rubber or plastic material. While in FIG. 11, the elastic element 16 is provided with the projections 30 containing gas therein, the projections being made of flexible rubber or plastic material.

Figure 12:
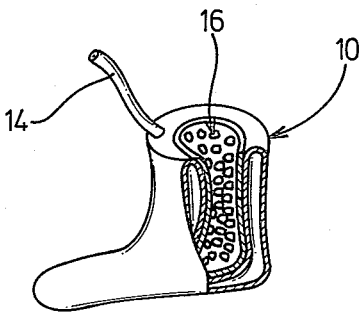
FIG. 12 is a partially broken perspective view of the device of another embodiment.

FIG. 12 shows an embodiment of the device, in which the air inflatable bag 10 is shaped into an article such as a shoe surrounding a given body portion such as a leg, to the whole inner surface of which is connected the elastic element 16. With use of this embodiment the better massage effect may be expected for the free end portions of the human body.

As hereinbefore described, the device according to the invention, besides the general usage of winding it round the body portion, may be constructed in the shape of the mat for protection of bedsores or shaped into the article surrounding the body portion, giving various types of massage effect.

Moreover, in the embodiments of FIGS. 1 to 4, hot or cold water may be introduced into the air bag 16 as the elastic element 16 for enhancement of the massage effect. Instead of introduction of the hot or cold water, a heating or cooling element especially in a gel state may be filled into the inside of the elastic bag element 16 for the similar effect.

Furthermore, in accordance with the invention the elastic element 16 may be releasably connected to the air inflatable bag or bags 10, thereby a number of combinations are possible between the various embodiments of the elastic elements and the air inflatable bags, giving a wide variety of massage effects.

The device according to the invention has a simple construction which can be manufactured at a low cost and the size and cost of the attached equipments may be reduced, so that the device can be readily and conveniently employed not only for an expert but also for a general home use.

The foregoing is to be considered as descriptive and not limitative as many changes and modifications can be made without departing from the spirit and scope of the invention.

What is claimed is:

1. Apparatus for air massage comprising a plurality of distinct air inflatable bags arranged in parallel alignment with each other, each having its own port for feeding and exhausting air and at least one elastic element attached to one surface of at least a portion of a number of inflatable bags, said elastic element comprising an elastic sheet provided with a plurality of independent air filled projections on the surface adapted to contact with a body part, said air inflatable bags being independently inflated and deflated relative to each other in a time difference so as to move said elastic element in a wavy manner.

2. The apparatus according to claim 1, wherein said elastic element is releasably connected to said air bags.

3. The apparatus according to claim 1, wherein the independent air filled projections of the elastic element is formed of a tongued and grooved face on the surface adapted to contact the body part.

4. The apparatus according to claim 1, wherein the elastic element is provided with a receiving bag for storing the plurality of air inflatable bags.

5. The apparatus according to claim 1, wherein the elastic element is provided with a heating or cooling element.

6. The apparatus according to claim 1, wherein the air inflatable bags are formed in the shape of a mat, over the whole upper surface of which is mounted the elastic element.

7. The apparatus according to claim 1, wherein the air inflatable bags are formed of flexible material and are adapted to be shaped for surrounding body parts over the whole inner surface of which is mounted the elastic element.

8. The apparatus according to claim 1, including a source of air and for conducting said air individually to the port of each of said air inflatable bags for selectively varying the volume of said individual air bag.

* * * * *